US005426803A

United States Patent [19]

Hamann

[11] Patent Number: 5,426,803

[45] Date of Patent: Jun. 27, 1995

[54] METHOD FOR PROCESSING DYE LIQUORS, IN PARTICULAR FOR TEXTILE DYEING AND POST-TREATMENT FACILITIES

[76] Inventor: Hans-Jörg Hamann, Hessenstr. 1, 30855 Langenhagen, Germany

[21] Appl. No.: 127,557

[22] Filed: Sep. 28, 1993

[30] Foreign Application Priority Data

Sep. 28, 1992 [DE] Germany ..... 42 32 293.6

[51] Int. Cl.[6] ..... D06B 3/12; D06B 23/00

[52] U.S. Cl. ..... 8/151; 8/158; 68/9; 68/18 F; 68/175; 68/184; 68/205 R

[58] Field of Search ..... 8/15, 158; 68/9, 18 F, 68/175, 184, 205 R

[56] References Cited

U.S. PATENT DOCUMENTS

| | | | |
|---|---|---|---|
| 3,518,848 | 7/1970 | Becker | 68/18 F |
| 3,717,015 | 2/1973 | Spencer | 68/18 F |
| 4,055,971 | 11/1977 | Hermes | 68/18 F X |
| 4,152,113 | 5/1979 | Walker et al. | 8/158 X |
| 4,520,520 | 6/1985 | Johnston et al. | 68/18 F X |
| 4,620,338 | 11/1986 | von der Eltz et al. | 8/158 X |
| 4,742,697 | 5/1988 | Sando et al. | 68/205 R X |

FOREIGN PATENT DOCUMENTS

| | | |
|---|---|---|
| 0470567 | 2/1992 | European Pat. Off. . |
| 2755579 | 6/1978 | Germany . |
| 2108542 | 5/1983 | United Kingdom . |

*Primary Examiner*—Philip R. Coe
*Attorney, Agent, or Firm*—Longacre & White

[57] ABSTRACT

The present invention is a method for processing dye-liquors, in particular dye-liquors for textile dyeing and post-treatment facilities. In particular, the present invention makes it possible to minimize the waste portion, and even entirely eliminate dyeing accessories, while textiles are treated in one or more subsequent dyeing chambers with heated dye liquors. The textiles to be treated are pulled in continuous transit, in one direction, through the associated equipment. Direction-reversing systems ensure a plurality of lengths of said textile are simultaneously in the dyeing chamber while the dye liquor is constantly cleaned and replenished by an apparatus which removes and reintroduction the dye-liquor in the dyeing chamber.

17 Claims, 3 Drawing Sheets

11
12
18
10
17
13
13
III
III
14
16
16a
14
15
15
19
19
IV
IV
16b
23
22
21
21
20

METHOD FOR PROCESSING DYE LIQUORS, IN PARTICULAR FOR TEXTILE DYEING AND POST-TREATMENT FACILITIES

BACKGROUND OF THE INVENTION a) Field of the Invention

The invention concerns a method for cleaning and replenishing dye-liquors. In particular, the dye-liquors used in textile dyeing and post-treatment facilities where the textiles are treated with heated dye-liquors in one or more sequential dye chambers.

b) Description of Related Art

Conventionally, textiles to be dyed are moved back and forth several times through dye liquor present in one or more dye-liquor chamber(s). This reciprocating motion of the textiles is also used in pre-dyeing and post-dyeing treatments which serve to deepen the colors and to achieve color evenness.

Further, it is known to raise the temperature of the dye and wash liquors to as much as 90° C., but below the boiling point of the liquor. This is generally carried out by heat pipes present inside a lower chamber, and in direct contact with the dye liquor.

Among the disadvantages of the conventional techniques are the so-called dyeing accessories which must be used to achieve dye adhesion. The accessories act like catalysts for enhancing dye deposition on the textiles. As a result, the dye liquor is not fully consumed during dyeing, and a residue containing as much as 20% dye-liquor is produced which must be disposed of as waste. These wastes are undesirable on ecological, as well as economic grounds.

SUMMARY OF THE INVENTION

It is an object of the present invention to create a process making it possible to minimize the waste portion and possibly to entirely eliminate dyeing accessories.

Accordingly, the present invention continuously pulls textiles to be treated through the associated equipment in only one direction. A substantial length of textile is treated in a single pass through the equipment wherein direction-reversing systems within the chamber(s) ensure adequate exposure of the textile to the dye-liquor. Finally, dye-liquor is continuously removed from each chamber, cleaned and replenished, and subsequently reintroduced into the chamber. The rate at which the dye-liquor is reprocessed is selected so that during the passage of a textile about 300 meters in length, dye-liquor reprocessing shall take place 30 to 60 times. In this way, approximately every 50 meters of the textile length will be subjected to dye-liquor deposition with reprocessed dye-liquor.

The transit speed of the textile is about 10 to 20 meters per minute. The total output of the facility is ordinarily achieved with this transit speed and the entailed transit length.

In addition to reprocessing during dyeing, reprocessing may also take place during pre-treatments or post-treatments on the textile.

The processing removes the dye-liquor from a receptacle, whereupon the dye-liquor is filtered, cleaned or otherwise processed in the manner described below, and then returned to the receptacle.

Another advantage of process according to the present invention is that because the supply of processed, i.e. cleaned and filtered, dye-liquor remains the same substance, the use of conventional dyeing accessories can be entirely eliminated. This advantage means the circulated dye liquor can be reused forever, its quantity being reduced only to the extent that some dye-liquor adheres to the textile. The deposition of dyeing accessories being rendered wholly superfluous, these dyeing accessories are neither supplied nor are they required to be removed as wastes. This raises yet another advantage of the present invention, namely that the textiles themselves no longer must be post-treated by the dealer or consumer, i.e. washing is no longer necessary.

Conventionally, the residual components of the treatment, in particular those of the dyeing accessories, will be flushed from textiles dyed by the known equipment during the first ten or so washes, making waste removal mandatory. This drawback is overcome in the textiles made by the present invention.

Another advantage of the present invention is that only a single facility is required for all dyeing and finishing steps, thereby eliminating the conventional intermediate drying stages for the textile.

Especially advantageous, continuous reprocessing of the removed dye liquor can be carried out during production, so that limitations on production time or the like do not occur.

Whereas in known equipment the textile is made to move back and forth through the dye liquor, the present invention advantageously displaces the dye liquor but not the textile. In other words, the textile moves only as required to advance through the equipment, while the dye-liquor is removed, reprocessed and reintroduced.

The present invention also makes possible dyeing particularly dense textiles in an easy manner while maintaining the above advantages. For instance, by introducing the dye-liquor through high-pressure nozzles pointed at the textile inside the treatment chamber. The high-pressure nozzles may operate at a pressure up to 16 bars. Alternatively, a pressure difference is created between two sections of a dye chamber on opposite sides of the textile which permits the dye-liquor to penetrate the fabric elements of dense textiles.

Foremost in the processing of the dye liquor is cleaning by filtering to remove impure ingredients from the dye liquor, e.g. the loose material which accumulates in textile manufacture. However, the filters also remove pesticides and other poisons from the textile, and may even treat the dye-liquor to the extent of ultrafiltration.

Another object of the dye-liquor processing is to replenish the dye-liquor from an additional dye supply which obviously must not result in a higher proportion of liquid, in particular a higher proportion of water. The dye-liquor is subjected to steam treatment to evaporate the excess water whereby the ratio of dye to liquid remains constant despite replenishing the supply of dye. Thus, during the processing, an amount of water is added together with the dye, and then is removed in the form of steam. The result of which is the relative proportion of dye in the water remains unchanged.

Steam is generated directly from the dye-liquor during the processing. The steam so generated can be simultaneously used in the first treatment stage within the deposition chamber, for instance to facilitate and improve textile dye absorption.

This is feasible because it is known that steam does not carry dyes and therefore the dye liquor will yield clean steam. The equipment of the invention therefore makes it possible to use the same dye liquor over very long periods of time. Because of the dye processing according to the present invention, fresh, reprocessed and cleaned dye-liquor is always available. Further, it is possible to obtain clean water by condensation from the steam generated according to the present invention. The clean water may also be used for other dye stages within the same facility.

The equipment for processing the dye liquor according to the present invention consists of two essentially nested heat-exchanger elements in which an outer element contains the dye liquor and an inner element includes heating tubes used for the steam generation.

The inner element is designed as a steam pipe and comprises a upper, cylindrical segment and a lower, conical segment. The dye liquor is converted in the upper, cylindrical segment into pure steam with increasing steam generation.

The portion of the dye-liquor within the inner element is reduced to such an extent by the steam generation that the dye proportion is more than in the initial dye liquor. Consequently, a relatively large proportion of dye remains in the lower, conical segment of the inner element.

There is only one transmission aperture between the lower, conical segment and the outer element. Consequently, transfer of dye-liquor into and out of the inner element for generating steam and for replenishing the dye-liquor, respectively, is regulated by the transmission aperture.

The maximum diameter of the lower, conical segment, at the base of the steam pipe, is appropriately somewhat less than the inside diameter of the outer element, whereby the dye liquor is able to pass between the outside diameter of the lower, conical segment and the inside diameter of the outer element. The heating zone associated with the steam pipe is enlarged by the lower, conical segment and the portion of the dye-liquor entering the zone can be fed comparatively rapidly to the evaporation stage.

The processing equipment may be fitted with an additional oil or electric heater mounted in pipes present in the bottom zone of the equipment.

The main portion of the dye-liquor must be kept at the ideal temperature (for instance 70° C.) required to obtain a particular hue. A double-wall jacket between the inner and outer elements of the dye-liquor evaporation system is filled with water. The water flowing continuously through the double jacket is cold (about 20° C.). This flow is implemented by a pump, and the flow rate can be regulated, thus allowing the dye-liquor to be accurately maintained at the desired temperature. Accordingly the various temperatures required for different hues are also easily set.

Additionally, compressed air may be fed into the evaporation system to raise the pressure throughout the entire equipment.

DESCRIPTION OF THE PREFERRED EMBODIMENT

Figure 1:
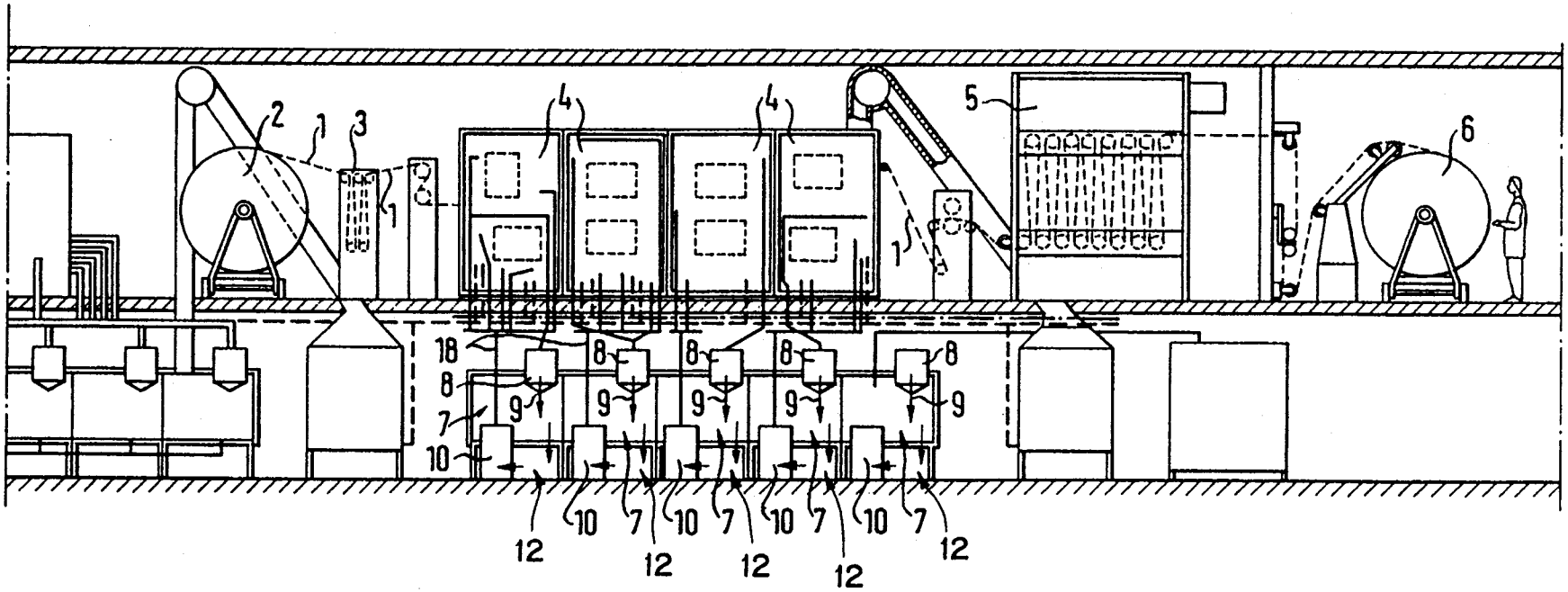
FIG. 1 is a schematic of a facility for dyeing textiles representing an application of the invention.

As shown in FIG. 1, a length of textile strip 1 is wound off a supply roll 2. The textile strip 1 passes through a stationary apparatus 3 wherein direction reversing systems accumulate, store and dispense the textile strip 1, and from which it is fed to one or more subsequent dye-liquor chambers 4. The direction reversing systems make possible continuous transit of the textile strip 1 through the dye-liquor chamber(s) 4, despite its considerable length, as well as facilitate the periodic need to replace a depleted supply roll 2 with a fresh supply roll 2 without stopping the equipment, etc.

The textile strip 1 is thereafter fed into a drying chamber 5 where direction reversing systems are used again before the textile strip 1 is wound onto a take-up spool 6.

Preferably a single, continuously transiting textile strip 1 is about 300 meters long, with dye-liquor cleaning and replenishing according to the present invention taking place about 30 to 60 times during the transit of such a strip.

A dye-liquor cleaning apparatus 7 is associated with each of the dye-liquor chambers 4. Each dye-liquor cleaning apparatus 7 receives the dye liquor to be cleaned and replenished from an intermediate reservoir 8. The intermediate reservoir 8 may be located above the dye-liquor cleaning apparatus 7 to provide gravity flow into the dye-liquor cleaning apparatus 7.

Figure 2:
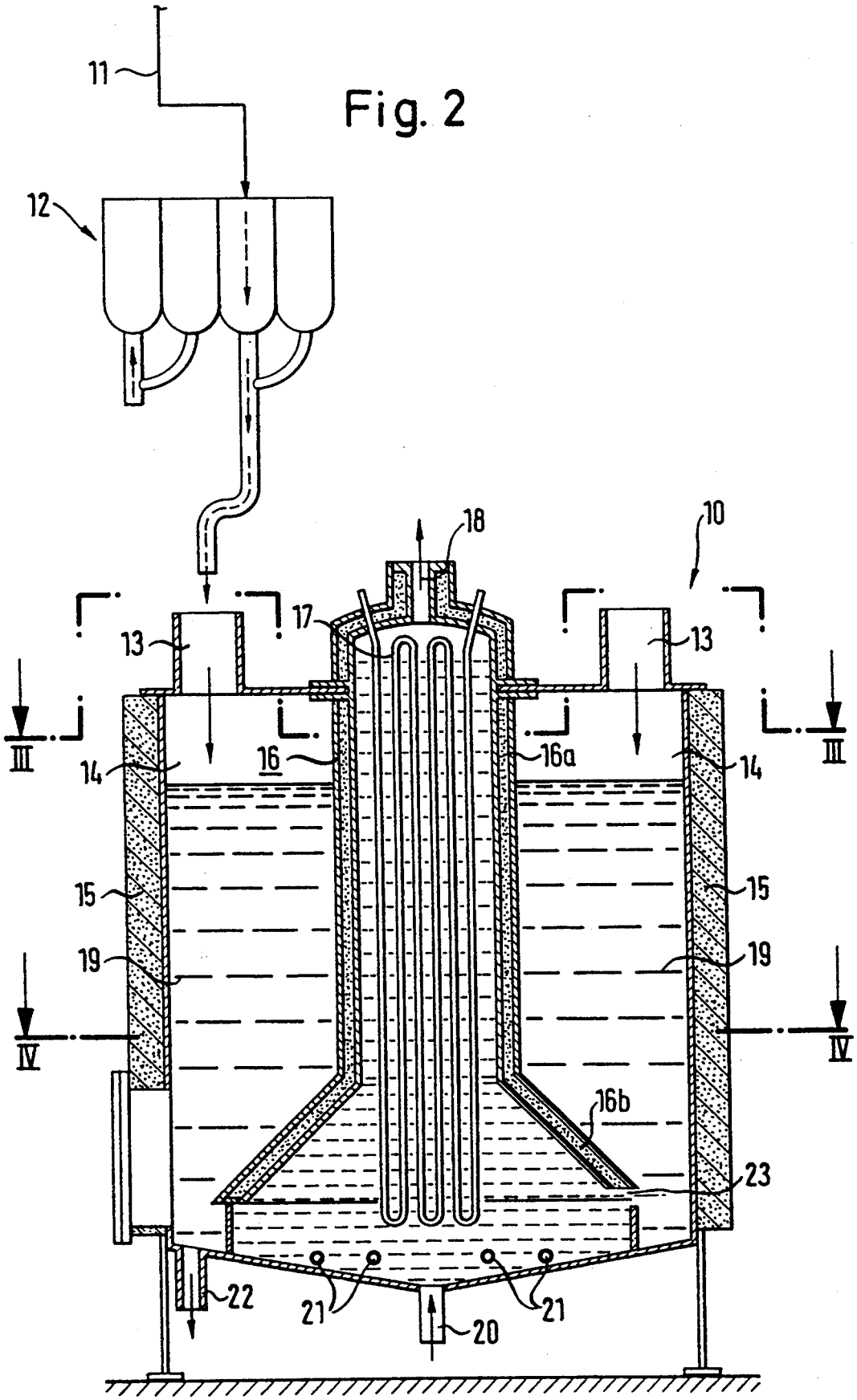
FIG. 2 is a cross-section of an embodiment mode of the evaporator of the invention.

An evaporation system 10 is associated with each cleaning apparatus 7. FIG. 2 shows the particulars of one of the evaporation systems 10. The dye liquor to be cleaned and replenished is moved in the direction of the arrow 11 through a schematically indicated multi-chamber dye-liquor checking and metering device 12, through openings 13, and into an annular jacket space 14. A comparatively thick insulating layer 15 is fitted around the outer perimeter of the annular jacket space 14. A heat exchanger 16 is located within an inner perimeter of the annular jacket space 14.

Figure 3:
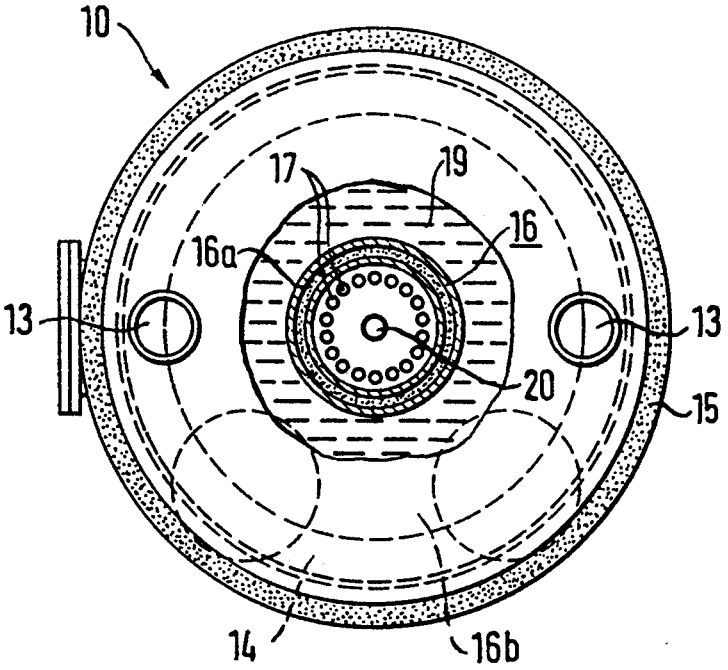
FIG. 3 is a cross-section along line III—III in FIG. 2.
Figure 4:
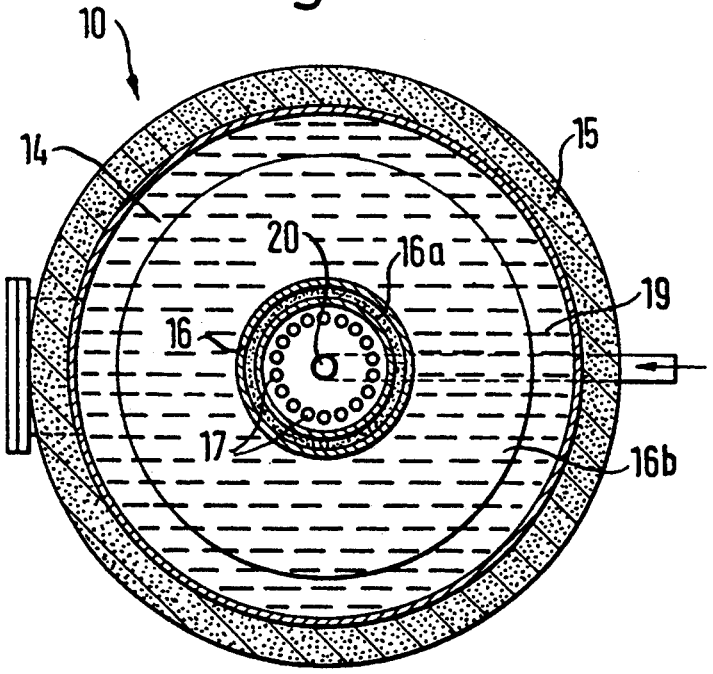
FIG. 4 is a cross-section along line IV—IV in FIG. 2.

The heat exchanger 16 includes circularly arrayed heat pipes 17 (also see FIG. 3) which heat the dye-liquor contained in the heat exchanger 16. The water contained within the dye-liquor in heat exchanger 16 is heated, and a portion is removed in the form of steam exiting from the evaporation system 10 in the direction of arrow 18. The steam may be recirculated in the dye-liquor chambers 4 (FIG. 1).

The heat exchanger 16 includes an upper, cylindrical segment **16*a* joined with a lower, conical segment 16*b*. In order to provide full steam generation in the lower, conical segment 16*b*, an additional heater may be incorporated in the form of heat pipes 21 mounted near the base of the lower, conical segment 16*b*. The heat exchanger 16 encloses a substantial amount of the dye liquor 19 held within the evaporation system 10**.

Compressed air can be fed up through a conduit 20 at the bottom of the evaporation system to enhance upward steam flow 18. Further, where denser textiles 1 are involved,.the enhanced steam flow 18 will facilitate dyeing more dense textile strips 1 at a higher pressure in the dye-liquor chamber 4.

Finally, the initial dye-liquor can be supplemented by means of a dye-liquor feed line 22 exiting off the bottom of the evaporation system. A transmission aperture 23 transfers dye-liquor 19 into and out of the heat exchanger 16 for generating steam 18 and for replenishing the dye-liquor 19, respectively. A pump (not shown) may be used to recycle the dye-liquor from the feed line 22 back to the dye-liquor chamber 4.

The present invention is not limited to the embodiment shown and described. Rather, the metes and bounds of the present invention are limited only by the following claims.

What is claimed is:

1. A method for processing dye-liquors used to dye or treat a textile, wherein the textile is treated with heated dye-liquor in at least one dyeing chamber, said method comprising the steps of:

pulling said textile to be treated in continuous transit through said dyeing chamber, said continuous transit occurring in a single direction;

treating said textile with said dye-liquor, including threading said textile around direction-reversing means for ensuring a plurality of lengths of said textile are simultaneously in said dyeing chamber; and, reprocessing said dye liquor to replenish said dye liquor, said reprocessing occurring continuously as said dye liquor is removed from and reintroduced into said dyeing chamber, wherein dye and water supplement said dye-liquor and a certain amount of water is subsequently removed in the form of steam to maintain the ratio of dye to water.

2. The method defined in claim 1, wherein said textile is approximately 300 meters long and said dye liquor is reprocessed 30-fold to 60-fold during said continuous transit of said textile.

3. The method defined in claim 2, wherein said reprocessing replenishes said dye-liquor during every 50 meters of said continuous transit.

4. The method defined in claim 1, wherein said continuous transit is approximately 10 to 20 meters per minute.

5. The method defined in claim 1, wherein said reprocessing is used during pre-treatment and post-treatment of said textile as well as during said treating.

6. The method defined in claim 1, wherein said reprocessing cleans and filters said dye-liquor removed from said dyeing chamber.

7. The method defined in claim 1, wherein said dye liquor is agitated before dye deposition by pressure spraying or pressure atomizing against said textile.

8. The method defined in claim 7, wherein said dye deposition occurs inside said dyeing chamber using high-pressure nozzles pointing at said textile.

9. The method defined in claim 8, wherein said high-pressure nozzles operate at 16 bars.

10. The method defined in claim 7, wherein a pressure difference is formed on opposite sides of said textile between to sections of the at least one dyeing chamber, thereby subjecting said textile to dye-liquor penetration into relatively dense fabric components.

11. The method defined in claim 1, further comprising:

filtering out loose components accumulated during textile manufacture from said dye-liquor.

12. The method defined in claim 11, wherein said filtering includes ultrafiltering said dye-liquor.

13. The method defined in claim 1, further comprising:

filtering out pesticides and other poisons from said textile.

14. The method defined in claim 13, wherein said filtering includes ultrafiltering said dye-liquor.

15. The method defined in claim 1, wherein steam is directly generated from said reprocessing of said dye-liquor.

16. The method defined in claim 1, wherein said steam is used in a first stage of treatment on said textile to facilitate and improve absorption of said dye-liquor.

17. The method defined in claim 1, wherein condensate from said steam is used in a second stage of treatment on said textile.

* * * * *